US005833190A

United States Patent [19]

Bishop

[11] Patent Number: 5,833,190

[45] Date of Patent: Nov. 10, 1998

[54] SHELF SUPPORTING BRACKET FOR A SCAFFOLD

[76] Inventor: Tommy J. Bishop, 177 S. Division St., Braidwood, Ill. 60408

[21] Appl. No.: 741,062

[22] Filed: Oct. 30, 1996

[51] Int. Cl.[6] ..... A47G 29/02

[52] U.S. Cl. ..... 248/238; 108/106; 182/186.9; 248/245; 248/295.11

[58] Field of Search ..... 248/235, 241, 248/243, 244, 245, 246, 217.1, 219.3, 219.4, 210, 238, 295.11; 108/144, 106, 107, 108, 110; 182/186.9

[56] References Cited

U.S. PATENT DOCUMENTS

| | | | |
|---|---|---|---|
| 2,342,427 | 2/1944 | Riblet | 248/246 |
| 2,414,078 | 1/1947 | Wetzel | 248/246 X |
| 2,727,712 | 12/1955 | Holmboe | 248/246 X |
| 2,897,013 | 7/1959 | Delp | 182/186.9 X |
| 3,473,774 | 10/1969 | Riblet | 248/246 |
| 3,493,208 | 2/1970 | Sato | 182/186.9 X |
| 4,969,620 | 11/1990 | Plummer | 248/246 |
| 5,535,974 | 7/1996 | Savitski | 248/246 |
| 5,644,993 | 7/1997 | Dohnalik | 248/217.1 X |

FOREIGN PATENT DOCUMENTS

| | | | |
|---|---|---|---|
| 1174952 | 7/1964 | Germany | 248/246 |
| 120194 | 5/1927 | Switzerland | 248/246 |
| 1345700 | 1/1974 | United Kingdom | 248/246 |

*Primary Examiner*—Derek J. Berger
*Attorney, Agent, or Firm*—Ernest Kettelson

[57] ABSTRACT

A shelf supporting bracket for a scaffold comprises a pair of spaced apart angle irons connected together by a first cross bar at the rear and a second cross bar located inwardly from the open front end. A diagonal brace bar extends downwardly and forwardly from the rearwardly facing end of the spaced apart angle irons and first cross bar, terminating forwardly at a location below the second cross bar and on a line that extends from the forwardly facing wall of the second cross bar normal to the direction in which the angle irons extend. A semi-cylindrical socket member is secured to the forward end of the diagonal brace bar to receive a lower portion of a scaffold upright when an upper portion is received through the open front end of the spaced apart angle irons and rearwardly to abut against the forwardly facing wall of the second cross bar. A pin is then inserted through a pair of aligned apertures of the spaced apart angle irons to the front of the scaffold upright. At such time, the spaced apart angle irons extend outwardly from the scaffold upright member in a position normal thereto. A second such bracket member is secured to a second spaced apart scaffold upright member and a plank or other shelf member is then laid across the two spaced apart shelf brackets.

9 Claims, 3 Drawing Sheets

SHELF SUPPORTING BRACKET FOR A SCAFFOLD

FIELD OF THE INVENTION

This invention relates to the field of brackets or other devices for connection to scaffolds which in turn support or hold something else, such as tools or materials that construction workers on or adjacent to the scaffold are using.

BACKGROUND OF THE INVENTION

In construction work such as brick laying, the workmen stand on platforms secured to a scaffold adjacent a brick wall that is being laid, moving the platform up on the scaffold as the wall is built up. Their bricks, mortar and other materials are laid on the platform they are standing on, which requires them to bend down to the platform floor level every time they need to reach another brick and another supply of mortar.

The present invention is an improvement over the prior art by providing novel shelf supporting brackets on which a plank can be laid for placement of the bricks, mortar and other working materials thereon at a level that is waist high to the workmen on the platform, or other convenient level for the workmen. They do not have to continuously bend down to the level of the platform they are standing on to reach the work materials when this invention is being used.

The shelf supporting brackets in accordance with this invention can be easily moved to any desired level on the upright members of the scaffold and secured in place at such level.

Prior art devices in this general field of which the inventor is aware include those described in the following United States Patents which are readily available to the public, U.S. Pat. No. 5,388,663; U.S. Pat. No. 5,156,235; U.S. Pat. No. 4,452,336; U.S. Pat. No. 3,493,208; U.S. Pat. No. 2,577,979; 2,414,078; U.S. Pat. No. 2,038,899; U.S. Pat. No. 1,698,607; U.S. Pat. No. 1,601,449; U.S. Pat. No. 1,166,118; U.S. Pat. No. 1,098,945; and U.S. Pat. No. 1,025,886.

SUMMARY OF THE INVENTION

The shelf supporting bracket in accordance with this invention comprises a pair of spaced apart angle irons about nineteen to twenty inches long, joined together by two cross bars, a first one across the rearwardly facing end and the second across an intermediate portion about eight to nine inches if from the forwardly facing open end.

An upright member of the scaffold is received through the open forwardly facing end into the channel between the angle irons to abut against the second cross bar. A pair of aligned apertures extend through the downwardly extending flange of the angle irons which border the receiving channel, at a location just forward of the scaffold upright when it abuts against the cross bar. A pin through the aligned apertures holds the upright member of the scaffold in this receiving pocket defined by the spaced apart angle irons, the second cross bar and the pin.

A diagonal brace bar extends downwardly and forwardly from the first cross bar at the rearwardly facing end of the angle irons, to which its rearwardly facing end is connected, and it terminates at a location below the point at which the second cross bar extends across between the spaced apart angle irons. A semi-cylindrical socket or cup is secured to the forward end of the diagonal brace bar. The semi-cylindrical socket or cup is thus located below and in axial alignment with the receiving pocket between the angle irons defined by the second cross bar to the rear of such pocket and by the pin through the aligned apertures to the front of such pocket.

A lower portion of the upright member of the scaffold is received in the cavity of the semi-cylindrical socket or cup and an upper portion is received in the receiving pocket between the angle irons, abutting against the second cross bar in back and against the pin to the front of the upright member. Such construction positions and holds the spaced apart angle irons outwardly to the rear of the upright member of the scaffold in a position that is normal or perpendicular to the upright member.

A second shelf supporting bracket in accordance with this invention may then be secured in the same way to another laterally spaced apart upright member of the scaffold at the same level. A plank is then laid across the laterally extending and upwardly facing flanges of the angle irons of both of the spaced apart shelf supporting brackets, on which the workmen can place the materials and tools they are working with.

DESCRIPTION OF PREFERRED EMBODIMENTS

Figure 1:
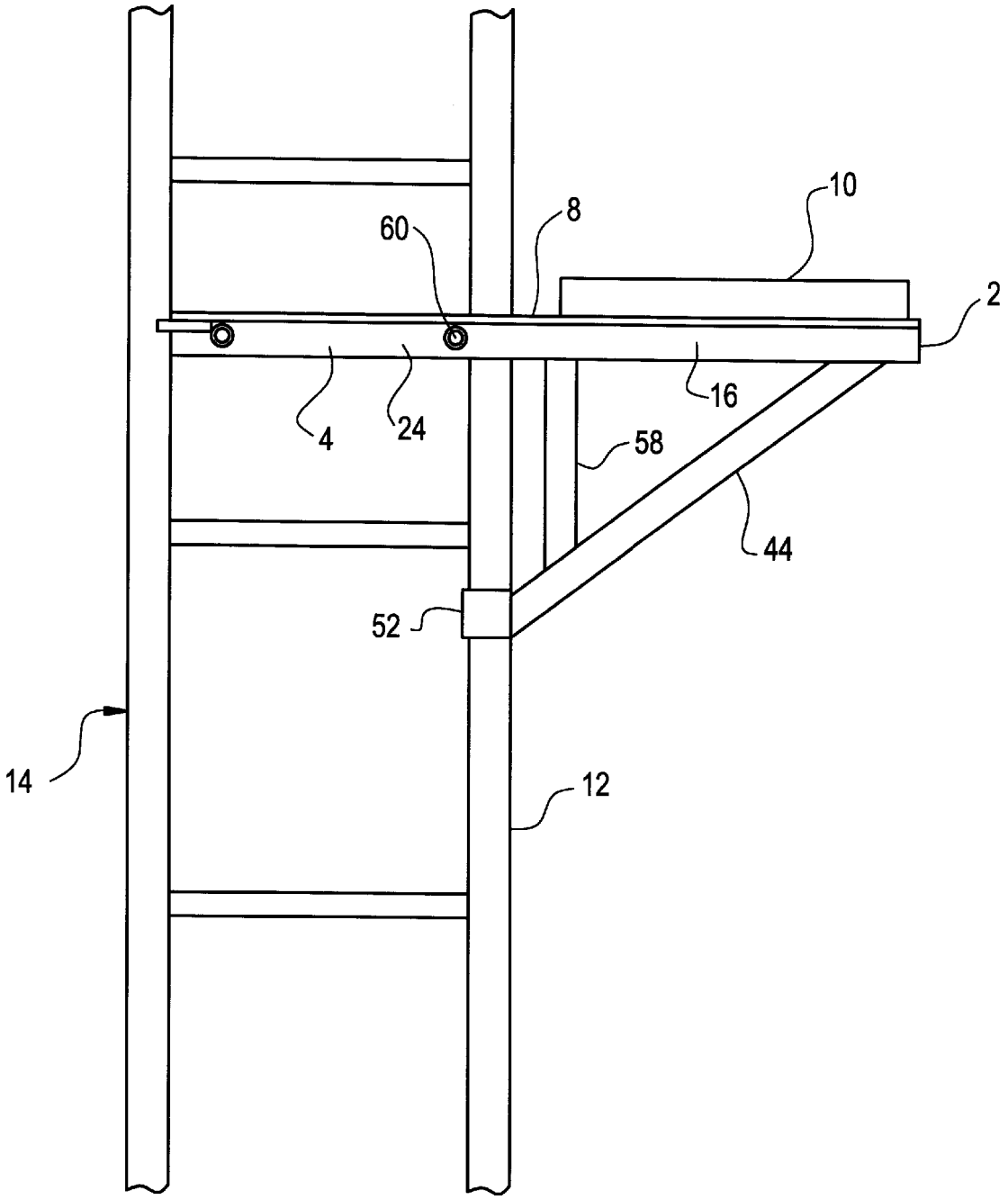
FIG. 1 is a side elevation view of a shelf supporting bracket in accordance with this invention shown secured in place on an upright member of a scaffold and with a plank shown thereon.
Figure 2:
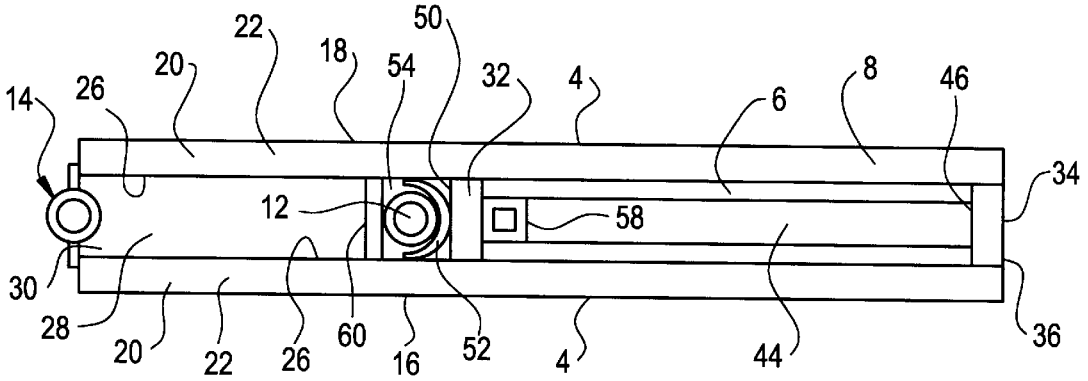
FIG. 2 is a plan view from above of a shelf supporting bracket of the kind shown in FIG. 1.
Figure 3:
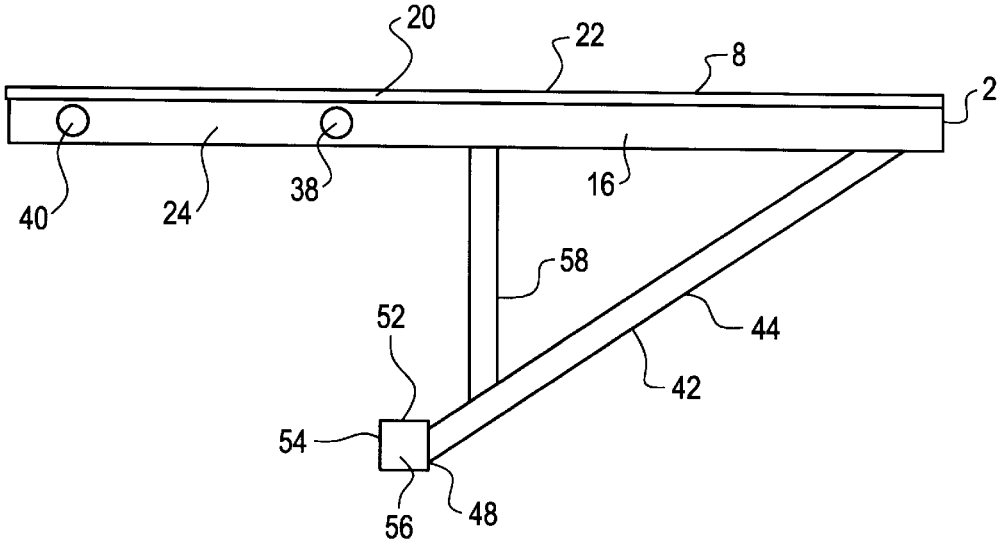
FIG. 3 is a side elevation view of a shelf supporting bracket in accordance with this invention shown disconnected from the scaffold.
Figure 4:
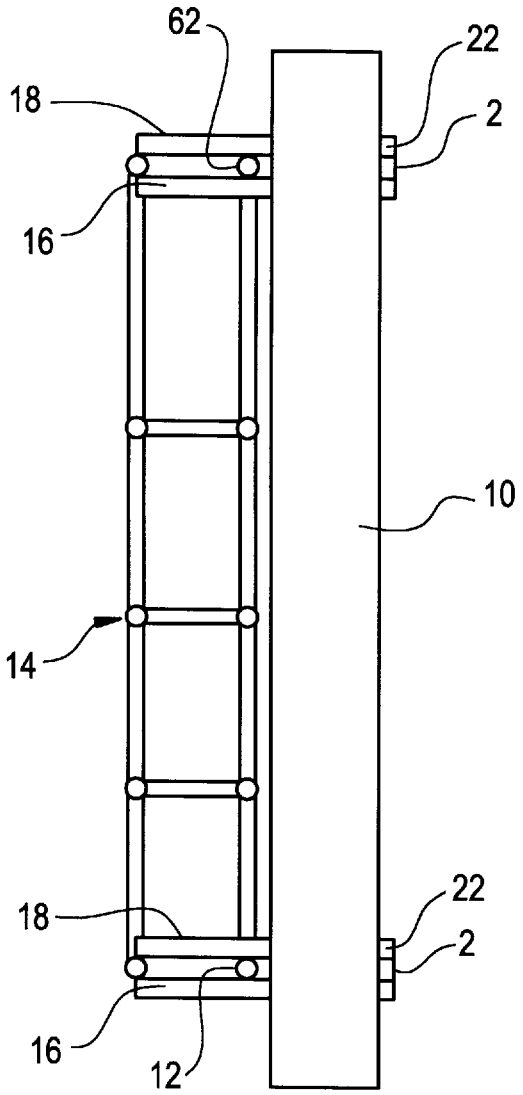
FIG. 4 is a plan view of two of the shelf supporting brackets in accordance with this invention shown secured to a scaffold in spaced apart relationship, with a plank shown extending across and being supported by the brackets.

A scaffold shelf supporting bracket 2 in accordance with this invention comprises a pair of elongated members 4 about nineteen inches in length and spaced apart about two inches or so to define an open space 6 therebetween.

The elongated members 4 have an upwardly facing planar surface 8 on which a plank 10 can be laid, extending from such surface 8 of one shelf supporting bracket 2 across to such surface 8 of a spaced apart second shelf supporting bracket 2 when both are secured to the upright members 12 of a scaffold 14.

The elongated members 4 in the embodiment shown and described herein comprise a first elongated angle iron 16 and a spaced apart second elongated angle iron 18. Each angle iron includes a laterally extending flange 20 having a planar surface 22 facing upwardly and a vertically extending flange 24 extending downwardly from the laterally extending flange and from their respective inner edges 26 which lie adjacent the open space 6 between the angle irons 16 and 18.

The downwardly extending flanges 24 provide spaced apart wall surfaces to form a receiving channel 28 extending from the open end 30 thereof inwardly of the spaced apart angle irons about eight inches or so, to receive an upright member 12 of a scaffold 14 in the channel 28.

The receiving channel 28 extends rearwardly from the open end 30 to terminate at an intermediate cross bar 32 extending across the open space 6 from angle iron 16 to angle iron 18.

A second cross bar 34 extends across the open space 6 between the angle irons 16 and 18 at the rearward facing end 36 of the spaced apart angle irons. In the embodiment shown, the distance between the intermediate cross bar 32 and the second cross bar 34 is about eleven inches.

A first pair of aligned apertures 38 are formed through the downwardly extending flanges 24 of angle irons 16 and 18 at a location about two and a half inches forwardly from the intermediate cross bar 32 in the direction toward the open end 30. A second pair of aligned apertures 40 are formed through the downwardly extending flanges 24 of angle irons 16 and 18 at a location about six inches forwardly from the intermediate cross bar 32.

A brace member 42 is secured to the angle irons 16 and 18 and extends downwardly therefrom to brace against a lower portion of the scaffold upright member 12 that is received in the channel 28 formed by the spaced apart angle irons.

The brace member 42 includes a diagonally extending elongated bar 44 having its upper and rearwardly facing end 46 secured to the second cross bar 34 at the rearwardly facing end 36 of the spaced apart angle irons. The lower and forwardly facing end 48 of the diagonal bar 44 terminates at a location below the forwardly facing wall 50 of the intermediate cross bar 32, and in the embodiment described herein at a distance between eight and nine inches below the planar surfaces 22 of the angle irons 16 and 18. An arcuately shaped cup or cradle member 52 extends from the forwardly facing end 48 of the diagonal brace bar 44, having an open end 54 to receive the said lower portion of the scaffold upright member 12 to seat in such cradle member 52 and bear against the semi-cylindrical wall 56 thereof.

A reinforcing support bar 58 extends from the rearwardly facing wall 60 of the intermediate cross bar 32 to which its upper end is secured, downwardly and vertically to intersect a portion of the diagonal brace bar 44 to which the lower end of the support bar 58 is secured.

The aligned apertures 38 are spaced apart forwardly of the forwardly facing wall 50 of intermediate cross bar 32 a distance corresponding to the outer diameter of a scaffold upright member 12 that is to be received in the channel 28. The dimensions set forth for the embodiment of the shelf bracket described herein are for scaffolds having upright members of two inch outer diameters. The width of the channel 28 and location of the aligned apertures 38 may vary to correspond with whatever diameter scaffold members the shelf supporting brackets are to be used with.

A pin 60 is placed through the aligned apertures 38 when the shelf supporting bracket 2 is mounted in place on the scaffold 14 with its upright member 12 received in the channel 28 between angle irons 16 and 18 and bearing against the intermediate cross bar 32. At such time a lower portion of the upright member 12 seats in the arcuate cup or cradle member 52 at the forward end of the diagonal bar 44 of the shelf bracket. The pin 60 holds the shelf bracket secured to the upright member 12.

A second shelf supporting bracket 2 is mounted on a second spaced apart scaffold upright 62 at the same level as the first shelf bracket. A plank 10 is then placed on the upwardly facing planar surfaces 22 of the angle irons 16 and 18, for workmen to place their construction materials thereon.

The shelf supporting brackets 2 in accordance with this invention and the plank 10 thereon, can be raised and lowered for positioning on the scaffold uprights at any desired height that is convenient for the workmen to easily reach the materials they are working with.

The arcuately shaped cup or cradle member 52, located at the forwardly facing end 48 of the diagonal brace bar 44, has its semi-cylindrical receiving cavity positioned in axial alignment with that part of the open space 6 of the receiving channel 28 between the forwardly facing wall 50 of intermediate cross bar 32 and the axis of the first pair of aligned apertures 38, in which space the scaffold upright member 12 is secured when received therein and pin 60 is placed through such aligned apertures. Such positioning of the cup or cradle member 52 holds and supports the angle irons 16 and 18 and their planar surfaces 22 substantially normally or perpendicular to the scaffold upright member 12 when the shelf supporting bracket 2 is secured in place as described on the scaffold upright member 12.

Another way of identifying the location of the cup or cradle 52 to support the angle irons 16 and 18 in a position substantially normal to the scaffold upright member is as follows. The mid-portion of the semi-cylindrical wall of the cradle 52 which is adjacent to the forwardly facing end 48 of the diagonal brace bar 44 lies below the forwardly facing wall 50 of the intermediate cross bar 32 between the angle irons 16 and 18, on a line that is substantially normal or perpendicular to the angle irons 16 and 18. When the shelf supporting bracket 2 is then secured to the scaffold upright member 12, such upright member bears against the wall 50 of cross bar 32 above and against the mid-portion of the cylindrical wall of the cup or cradle 52 below along such line, thereby supporting the angle irons 16 and 18 and their planar surfaces 22 in a position substantially normal to the scaffold upright member 12.

I claim:

1. A shelf supporting bracket for securing to an upright member of a scaffold, comprising an elongated shelf supporting member having an upwardly facing planar bearing surface extending both forwardly and rearwardly of said upright member when said shelf supporting bracket is in position on said scaffold, securing means to secure said shelf supporting member to said upright member of said scaffold, and bracket support means to support said elongated shelf supporting member at a position substantially normal to said upright member when secured thereto, wherein said elongated shelf supporting member includes a rearwardly extending portion having said upwardly facing bearing surface thereon terminating rearwardly in a rearwardly facing end, and a forwardly extending portion also having said upwardly facing bearing surface thereon which terminates forwardly in a forwardly facing end, an upright receiving cavity through said forwardly extending portion to receive said upright member of a scaffold and hold in position therein when said shelf supporting bracket is in position on said scaffold, wherein said upright receiving cavity comprises a channel extending rearwardly in said forwardly extending portion of said elongated shelf supporting member from said forwardly facing end, said channel opening to said forwardly facing end of said forwardly extending portion, said channel extending rearwardly about eight inches from said forwardly facing end to terminate at a rearward channel abutment surface, and movable cavity securing means movable between a cavity closed position to hold said upright of a scaffold in said cavity and a cavity open position for movement of said upright through said channel into and out of said receiving cavity.

2. A shelf supporting bracket for securing to an upright member of a scaffold as set forth in claim 1, wherein said movable cavity securing means comprises aligned aperture means for receiving a pin therethrough extending through said forwardly extending portion of said elongated shelf supporting member from each opposite side of said channel, a pin extendable through said aligned aperture means across said channel and removable therefrom.

3. A shelf supporting bracket for securing to an upright member of a scaffold as set forth in claim 2, wherein said bracket support means includes a bearing member having a forwardly facing bearing surface, a support member extending downwardly from said elongated shelf supporting member having said bearing member thereon at a position below said rearward channel abutment surface of said upright receiving cavity, said forwardly facing surface of said bearing member and said rearward channel abutment surface being in spaced apart axial alignment on a line which extends normal to said planar bearing surface of said elongated shelf supporting member whereby said elongated shelf supporting member is supported at said position substantially normal to said upright member of said scaffold when secured thereto.

4. A shelf supporting bracket for securing to an upright member of a scaffold as set forth in claim 2, wherein said bracket support means includes a cup member having a semi-cylindrical wall defining a semi-cylindrical receiving cavity having an entrance thereto and an open wall facing forwardly at the said entrance to said semi-cylindrical receiving cavity, a support member extending downwardly from said elongated shelf supporting member having said cup member thereon, said upright receiving cavity of said forwardly extending portion of said elongated shelf supporting member being in substantially axial alignment with said semi-cylindrical receiving cavity of said cup member.

5. A shelf supporting bracket for securing to an upright member of a scaffold as set forth in claim 4, wherein said support member extending downwardly from said elongated shelf supporting member comprises a diagonally extending bar having a rearward end secured to said rearwardly facing end of said elongated shelf supporting member and a forward end secured to said cup member having said semi-cylindrical wall and said semi-cylindrical receiving cavity.

6. A shelf supporting bracket for securing to an upright member of a scaffold as set forth in claim 5, including a reinforcing bar extending downwardly between said elongated shelf supporting member to which it is secured at its upper end and said diagonally extending bar to which it is secured at its lower end.

7. A shelf supporting bracket for securing to an upright member of a scaffold as set forth in claim 1, wherein said elongated shelf supporting member comprises a pair of spaced apart angle irons.

8. A shelf supporting bracket for securing to an upright member of a scaffold as set forth in claim 7, including a first cross bar extending across between said spaced apart angle irons, said first cross bar having a forwardly facing wall surface, said rearward channel abutment surface being on said forwardly facing wall surface of said first cross bar.

9. A shelf supporting bracket for securing to an upright member of a scaffold as set forth in claim 8, including a second cross bar extending across between said spaced apart angle irons at said rearwardly facing end of said elongated shelf supporting member.

* * * * *